US005577442A

United States Patent [19]

Tanaka et al.

[11] Patent Number: 5,577,442

[45] Date of Patent: Nov. 26, 1996

[54] DEVICE FOR SUPPLYING INK IN A FILMY FASHION

[75] Inventors: Yuji Tanaka, Oume; Kouichi Orita, Fuchuu, both of Japan

[73] Assignee: Kabushiki Kaisha Shinkawa, Tokyo, Japan

[21] Appl. No.: 416,996

[22] Filed: Apr. 5, 1995

[30] Foreign Application Priority Data

Apr. 7, 1994 [JP] Japan ..... 6-093791

[51] Int. Cl.[6] ..... B41F 9/10; B41F 31/04

[52] U.S. Cl. ..... 101/163; 101/169

[58] Field of Search ..... 101/163, 364, 101/157, 169, 35, 41, 44, 150, 155, 167, 365; 118/261

[56] References Cited

U.S. PATENT DOCUMENTS 4,557,195 12/1985 Philipp ..... 101/163

5,272,973 12/1993 Chojnacki ..... 101/163

5,419,247 5/1995 Bachmann ..... 101/364

FOREIGN PATENT DOCUMENTS 3-43250 2/1991 Japan ..... B41F 17/34

*Primary Examiner*—J. Reed Fisher

*Attorney, Agent, or Firm*—Koda and Androlia

[57] ABSTRACT

So as to prevent ink leakage and reduce the amount of ink consumed, the device for supplying ink in a thin-film fashion to a printing plate includes rotation-stop members provided on an ink supply so that the rotation-stop members prevent any upward movement that would occur at an end portion of the ink supply with which a horizontally movable printing plate is in contact.

7 Claims, 5 Drawing Sheets

DEVICE FOR SUPPLYING INK IN A FILMY FASHION

BACKGROUND OF THE INVENTION

1. Field of the Invention

The present invention relates to a device for supplying a liquid coating or ink in a state of thin-film in relief printing machines, a liquid coating supplying device in die bonders, etc.

2. Prior Art

Conventional thin-film supplying devices include, for example, a device disclosed in Japanese Patent Application Laid-Open (Kokai) No. 3-43250 which is shown in FIG. 7.

This device includes a printing plate 1 which has a recessed area 1*a* formed in its upper surface, a table 2 which holds the printing plate 1, a pot holder 3 which is installed above the printing plate 1 in a vertically movable manner, and an ink pot 4 which is held by the pot holder 3. The ink pot 4 consists of a tank 6 which accommodates a liquid coating or ink 5, a cover 7 which covers the top of the tank 6, and a blade 8 which is attached to the bottom of the tank 6. A circular recessed liquid reservoir 8*a* for storing the ink 5 therein is formed in the undersurface of the blade 8.

When the table 2 moves horizontally to the right or in the direction indicated by arrow A as shown by the two-dot chain line after the ink pot 4 has been lowered and the bottom of the blade 8 is pressed against the printing plate 1, the ink 5 inside the ink reservoir 8*a* uniformly fills the recessed area 1*a* of the printing plate 1.

Next, a plate holder 10 is lowered as shown by the two-dotted chain line; as a result, a rubber relief plate 11 on the plate 10 contacts the ink 5 in the recessed area 1*a* so that ink 5 is applied to the rubber relief plate 11. The plate holder 10 is raised, and the table 2 is moved back horizontally to the left in the direction indicated by arrow B. Afterward, the plate holder 10 is further lowered as indicated by the two-dot chain line so that the rubber relief plate 11 is pressed against the object 12 on which printing is to be performed. Thus, the ink 5 on the undersurface of the rubber relief plate 11 is transferred to the object 12. The plate holder 10 then returns to its original position.

In the prior art described above, the ink pot 4 is provided on the pot holder 3 via four adjustment screws (not shown) which are attached to the pot holder 3 on the left, right, front and back and adjusted so that the undersurface of the blade 8 is maintained parallel to the printing plate 1. As a result, the blade 8 may be loosened by wear that occurs during the horizontal movement of the printing plate 1, which causes the ink 5 to leak from the ink reservoir 8*a*. When the printing plate 1 moves in the direction of B, a rotational moment acts on the blade 8 in the direction of arrow C, so that the leading-edge undersurface 8*b* of the blade 8 floats upwardly. In other words, ink 5 is scraped off by the trailing-edge undersurface 8*c* of the blade 8, and ink 5 in the ink reservoir 8*a* leaks from the leading-edge undersurface 8*b* of the blade 8, which is not in contact with the printing plate 1. As a result, the amount of ink 5 consumed is increased.

Furthermore, since the undersurface of the blade 8 is round, the application of a rotational moment in the direction of arrow C results in that the blade 8 contacts the printing plate 1 at one point only, with the remaining parts of the blade 8 kept above the printing plate 1. As a result, when the blade 8 moves and scrapes the upper surface of the ink 5 that has accumulated in the recessed area 1*a*, the ink 5 is scraped by various parts of the undersurface of the blade 8 which are at different heights, and a thin film of ink 5 is not uniformly supplied to the recessed area 1*a*.

In addition, when adjusting the blade 8 to contact the printing plate 1 without any gap between the two, it is necessary to turn the four adjustment screws of the pot holder 3 so that the undersurface of the blade 8 is parallel to the upper surface of the printing plate 1. The adjustment work for obtaining this parallel orientation, however, requires considerable time.

SUMMARY OF THE INVENTION

Accordingly, the object of the present invention is to provide a device for supplying a liquid coating or ink in a filmy fashion without any ink leakage, thus greatly reducing the amount of ink consumed.

Another object of the present invention is to provide a device for supplying ink in a thin-film fashion which is free of adjustment work to obtain a parallel blade orientation.

Still another object of the present invention is to provide a thin-filmy ink supplying device which supplies uniform thin films of ink.

The objects of the present invention are accomplished by a unique structure for a thin-film supplying device that includes: a printing plate which has a recessed area on its upper surface, a table which holds the printing plate, a pot which accommodates a liquid coating or ink and has a blade that has an ink reservoir formed in its lower end, a pot holder which holds the pot, and a horizontal driving means which moves the printing plate and pot horizontally relative to each other with the undersurface of the blade of the pot pressed against the upper surface of the printing plate; and the uniqueness of the structure is that a rotation-stop means which prevents the rotation of the blade is installed on both side surfaces of the pot holder in the direction of relative movement between the pot and printing plate.

The objects of the present invention are accomplished by another unique structure for a thin-film supplying device wherein in addition to the structure described above, the pot is held on the pot holder with a slight gap between the pot and pot holder, and the pot is urged by a multiple number of springs attached to the pot holder so that the pot is kept pressed against the printing plate.

The objects of the present invention is further accomplished by a still another unique structure wherein in addition to the structure described above, the blade is formed in a square shape.

In the present invention, the rotation-stop means which refrains the rotation of the blade are provided on both sides of the pot holder in the direction of movement of the printing plate. Accordingly, when the printing plate and ink pot move relative to each other, the upper part of the leading edge of the blade in the direction of movement comes in contact with the rotation-stop means, so that the blade is pressed against the printing plate by the rotation-stop means. As a result, the undersurface of the blade does not float upward. Since the blade is thus prevented from moving upward, there is no ink leakage, and the amount of ink consumed is greatly reduced.

In addition, a pot insertion hole is formed in the pot holder so as to be slightly larger than the external diameter of the ink pot, so that there is a certain play which allows the rotation of the ink pot. Furthermore, since the blade of the ink pot is pressed against the printing plate by springs which are attached to the pot holder so that the blade is urged to conform to the surface of the printing plate by the multiple number of springs, there is no need to perform an adjustment work to maintain the undersurface of the blade parallel to the surface of the printing plate.

Furthermore, the undersurface of the blade of the ink pot has a square shape. Accordingly, the undersurface of the blade scrapes the ink inside the recessed area of the printing plate in linear contact, and a uniform thin film of ink can be supplied to the recessed area.

BRIEF DESCRIPTION OF THE DRAWINGS

FIG. 6 illustrates the ink pot used in the present invention wherein FIG. 6*a* is a sectional view, and FIG. 6*b* is a bottom view.

DETAILED DESCRIPTION OF THE INVENTION

One embodiment of the present invention will be described with reference to FIGS. 1 through 6.

Figure 1:
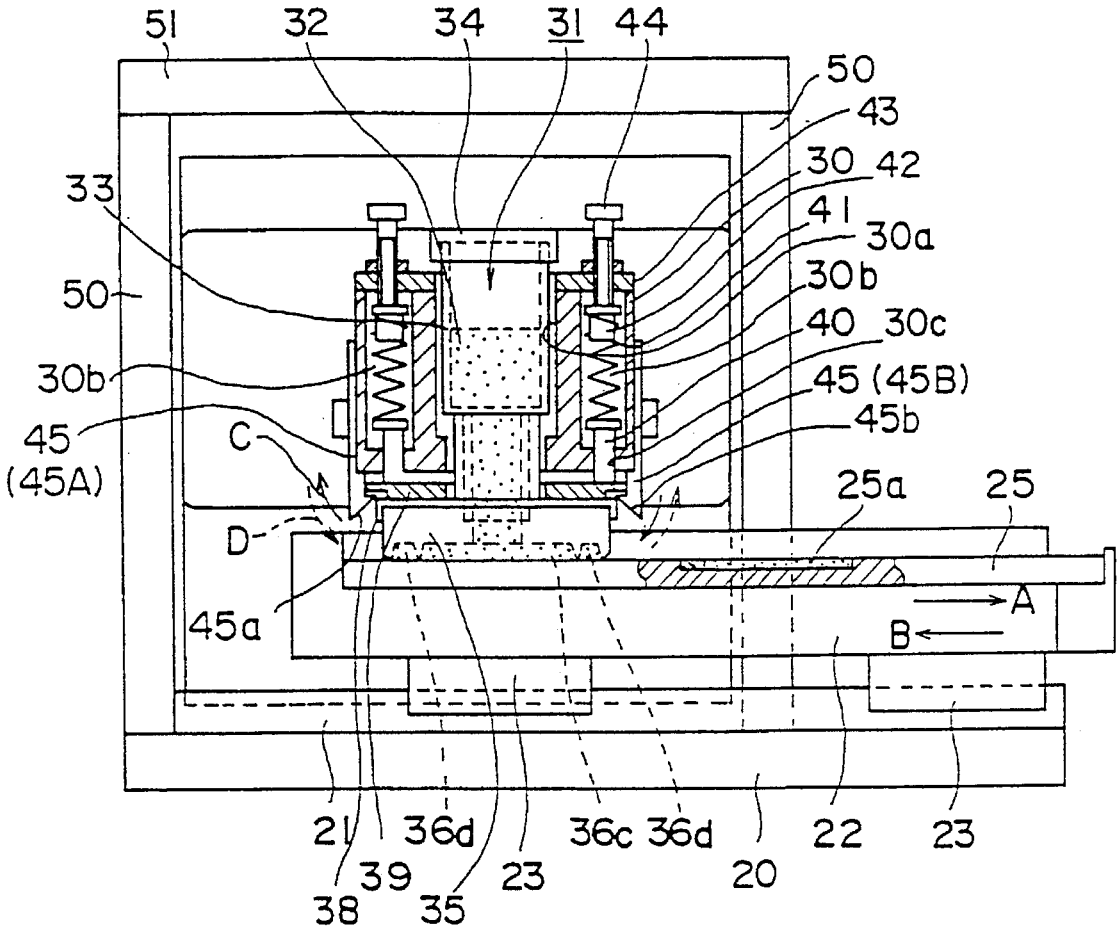
FIG. 1 is a front view of one embodiment of the thin-film supplying device of the present invention.
Figure 2:
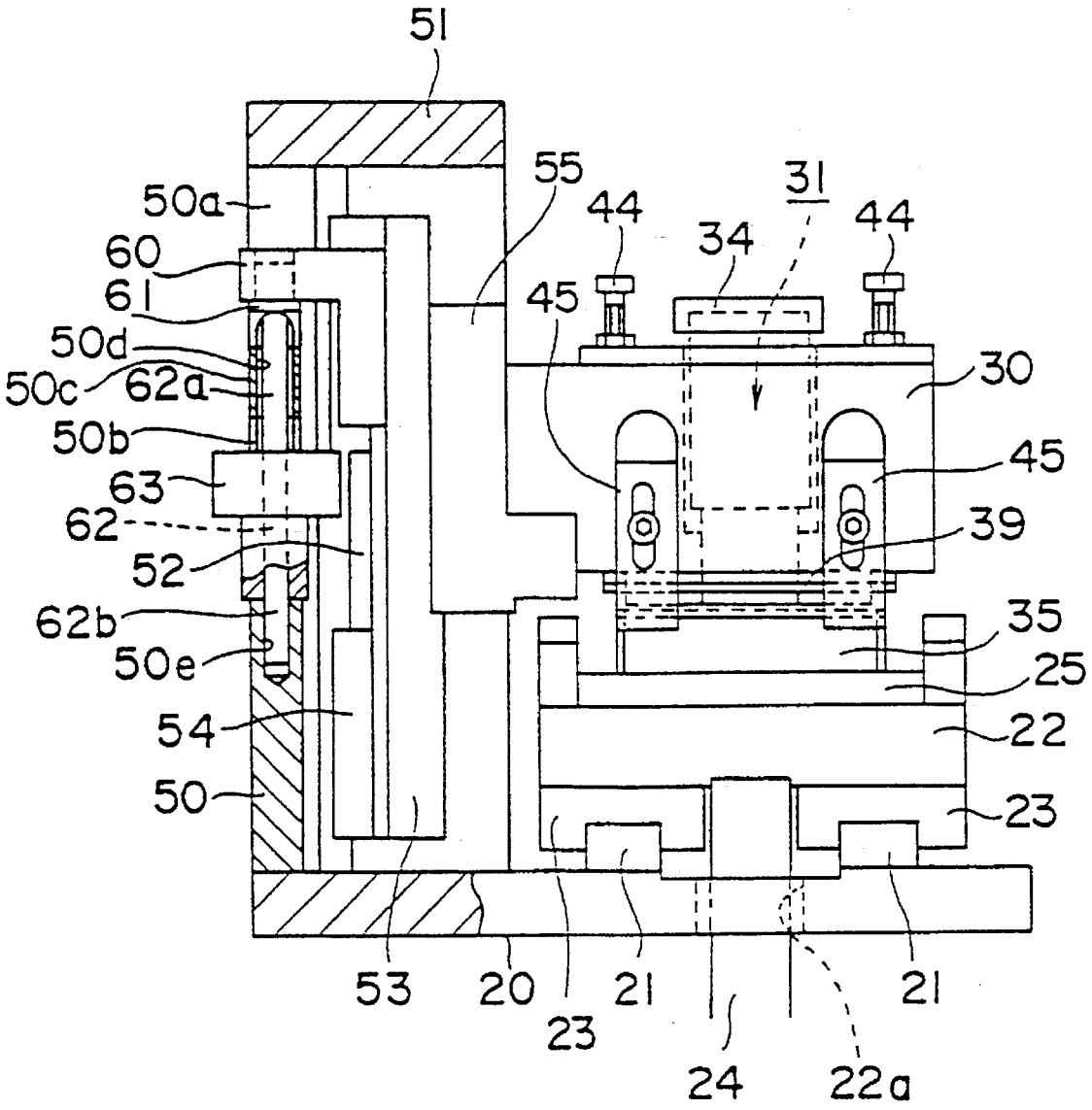
FIG. 2 is a left-side view thereof.

As shown in FIGS. 1 and 2, two guide rails 21 are provided on a base plate 20, and sliders 23 which have a table 22 thereon are slidably mounted on the guide rails 21. The table 22 is movable by a horizontal driving means (not shown).

A driving lever 24 which passes through a hole 22*a* of the base plate 20 is connected to the undersurface of the table 22. This driving lever 24 is moved horizontally (right and left in FIG. 1) by the horizontal driving means (not shown).

A printing plate 25 made of a super-steel or another metal plate is fastened on the table 22 at a fixed position. A recessed area 25*a* with a depth, approximately 4 to 12 microns, that corresponds to the thickness of the ink film applied to an object on which printing is to be performed, is formed in the upper surface of the printing plate 25.

A pot holder 30 is installed above the printing plate 25. The pot holder 30 has a pot insertion hole 30*a* in the central part thereof so that an ink pot 31 is installed in the hole 30*a*. The pot insertion hole 30*a* of the pot holder 30 has a diameter which is approximately 1 mm larger than the external diameter of the ink pot 31.

Figure 6:
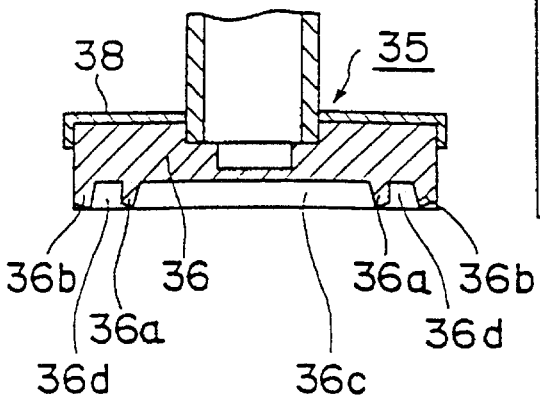
Figure 6:
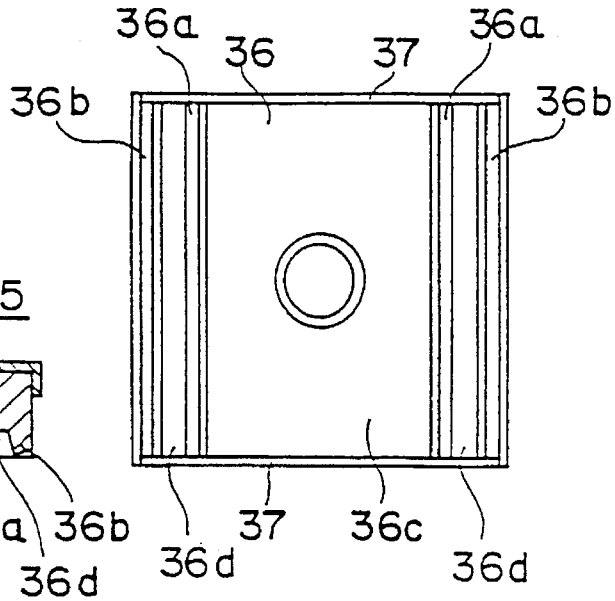

The ink pot 31 is comprised of an ink tank 33 which accommodates ink 32, a cover 34 which covers the ink tank 33, and a blade 35 which is fastened to the bottom of the ink tank 30. As shown in FIG. 6, the blade 35 has a square shape and includes a blade main body 36 and side plates 37. Furthermore, a cover 38 is fastened on the blade 35, and a spacer 39 is mounted on top of the cover 38. The blade main body 36 and the side plates 37 are made of a ceramic material, and the cover 38 is of an SUS material.

As best shown in FIG. 6, two first projections 36*a* are formed parallel to and facing each other on the undersurface of the blade main body 36. The projections 36*a* are separated by a distance slightly greater than the width of the recessed area 25*a* (i.e., the width in the direction perpendicular to the direction of movement of the printing plate 25) formed in the printing plate 25 shown in FIG. 1. Respective second projections 36*b* are formed in parallel on the outside of the first projections 36*a*.

The side plates 37 are fastened to both side surfaces of the blade main body 36 so as to be at the ends of the first and second projections 36*a* and 36*b*.

An ink reservoir 36*c* is defined by the two first projections 36*a* and two side plates 37; and leaking-ink reservoirs 36*d* are defined by the first projections 36*a*, second projections 36*b* and side plates 37.

The blade main body 36 and the side plates 37 can be made as a single integral unit instead of as separate elements as describe above. However, it is preferable to make the blade 35 from a ceramic material; thus, the ink reservoir 36*c* and leaking-ink reservoirs 36*d* are easier to make if these are separate elements.

Figure 3:
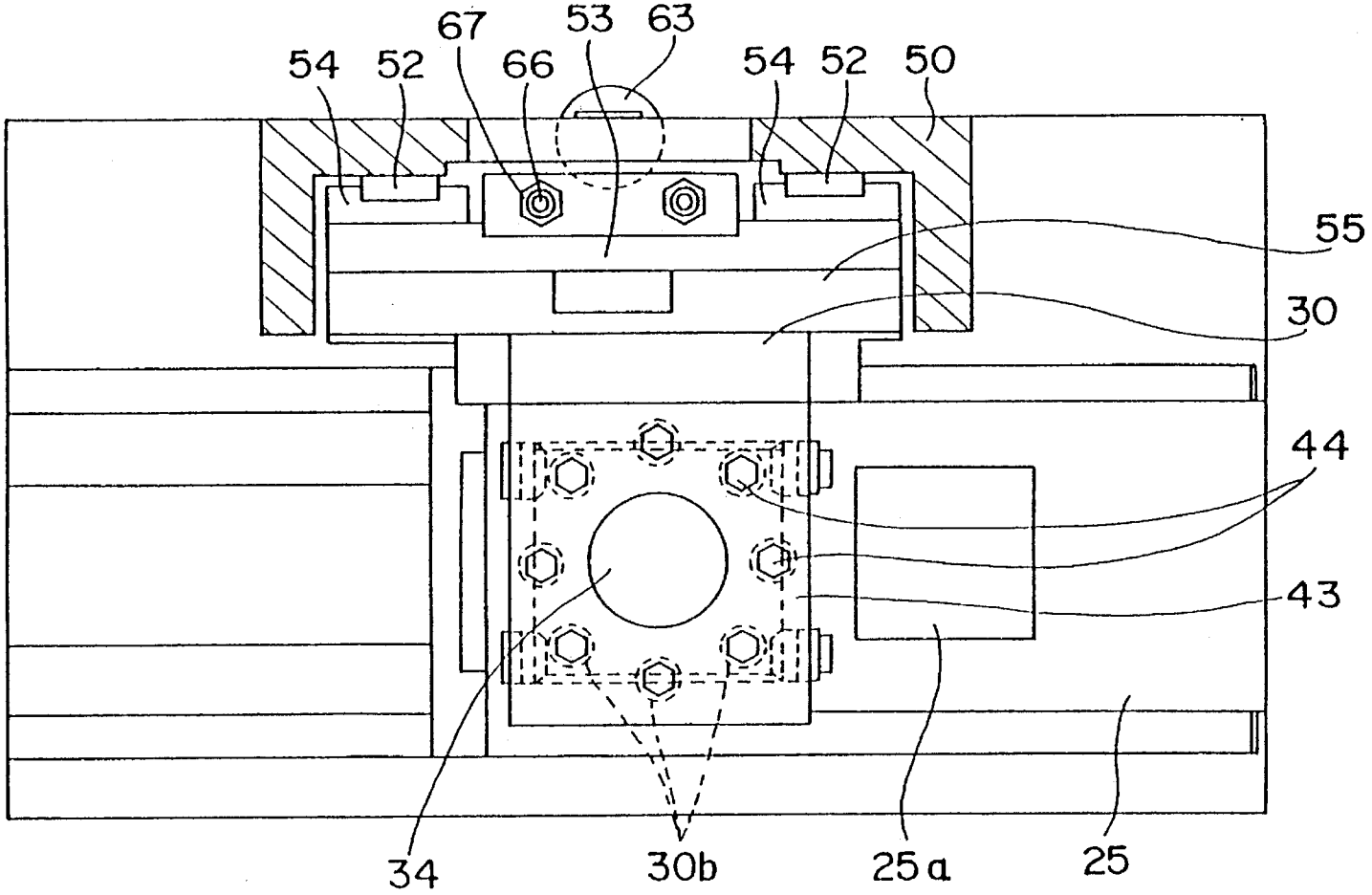
FIG. 3 is a top view thereof.

As shown in FIGS. 1 through 3, eight spring attachment holes 30*b* are formed in the pot holder 30 at equal intervals in a concentric-circular pattern around the pot insertion hole 30*a*. Pressing member insertion holes 30*c* are formed at the bottoms of the spring attachment holes 30*b*, and pressing members 40 are inserted into the pressing member insertion holes 30*c* so that the pressing members 40 can move up and down. In addition, loading springs 41 are mounted on the upper surfaces of the pressing members 40. The loading springs 41 have connecting members 42 on the upper ends.

A holder cover 43 is fastened on the pot holder 30, and load adjustment screws 44 are screw-engaged with the holder cover 43 so as to positionally correspond to the spring attachment holes 30*b*.

Rotation-stop members 45 are provided on both side surfaces of the pot holder 30 in the direction of movement of the table 22. In other words, two of the rotation-stop members 45 (referred to as 45A and 45B) are provided on each one of the side surfaces of the pot holder 30. Thus, a total of four rotation-stop members 45 are used. The lower end of each of the rotation-stop members 45 has inclined surfaces 45*a* and 45*b* which contact the cover 38 of the blade 35.

As shown in FIGS. 2 through 5, a frame 50 is mounted on the base plate 20, and a top plate 51 is fastened to the upper end of the frame 50. Two vertically oriented guide rails 52 are installed parallel to each other in the frame 50 so as to face the pot holder 30, and sliders 54 which are fastened to a vertical-moving plate 53 are fit over the guide rails 52 so that the sliders 54 are movable up and down. A pot-fastening support 55 is fastened to the vertical-moving plate 53, and the pot holder 30 is mounted to the pot-fastening support 55.

In addition, an L-shaped block 60 is fastened to the upper end of the vertical-moving plate 53 so that a tip portion of the L-shaped block 60 faces a window 50*a* formed in the upper portion of the frame 50, and a stopper 61 is fastened to the undersurface of the L-shaped block 60.

Another window 50*b* is opened in the frame 50 beneath the window 50*a*, thus a rib 50*c* is formed between the windows 50*a* and 50*b* beneath the stopper 61.

A vertically oriented internal threaded portion 50*d* is formed in the rib 50*c*, and a hole 50*e* is formed in the lower end surface of the window 50*b* along a line which is an extension of the internal threaded portion 50*d*.

The external threaded portion 62*a* of a pot vertical adjustment bolt 62 used for vertical adjustment of the ink pot is screw-engaged with the internal threaded portion 50*d*, and the shank portion 62*b* of the pot vertical adjustment bolt 62 is inserted into the hole 50*e* so that the shank portion 62*b* is rotatable and movable up and down in the hole 50*e*.

Furthermore, a knob 63 for turning the pot vertical adjustment bolt 62 is fastened to this bolt 62.

Figure 4:
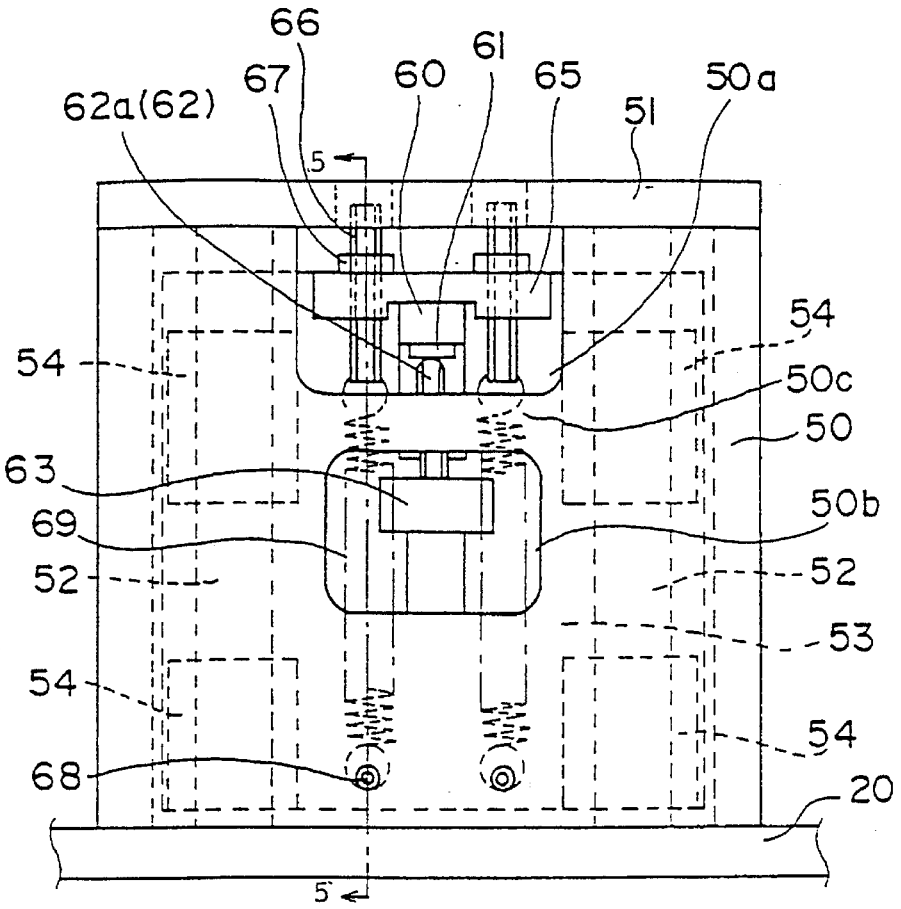
FIG. 4 is a rear view thereof.
Figure 5:
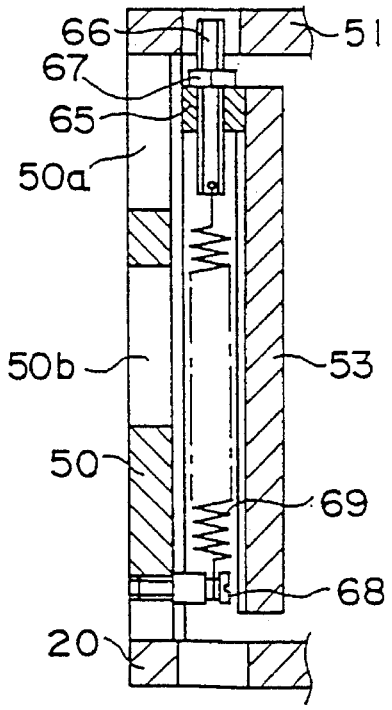
FIG. 5 is a cross sectional view taken along line 5—5 in FIG. 4.

As shown in FIGS. 4 and 5, a hanger block 65 is fastened to the upper portion of the vertical-moving plate 53, and spring attachment bolts 66 are passed through the hanger block 65 with a certain amount of play in between. Nuts 67 which are carried on the upper surface of the hanger block 65 are screw-engaged with the spring attachment bolts 66.

Spring attachment pins 68 are fastened to the lower portion of the frame 50 so as to positionally correspond to the spring attachment bolts 66, and springs 69 are mounted between the spring attachment bolts 66 and the spring attachment pins 68. Accordingly, the vertical-moving plate 53 which has the hanger block 65, and the L-shaped block 60 and pot holder 30 which are fastened to the vertical-moving plate 53, are urged downward by the springs 69.

The operation of the embodiment described above will be described.

An preparation adjustment is performed before the device starts supplying ink to the printing plate.

The knob 63 is first turned to raise the pot vertical adjustment bolt 62 and also the pot holder 30 and ink pot 31 so that the ink pot 31 is separated from the printing plate 25 and positioned above.

More specifically, when the knob 63 is turned in the "raising" direction, the hanger block 65 is raised against the spring force of the springs 69 by the action of the internal threaded portion 50*d* formed in the frame 50 and the external threaded portion 62*a* of the pot vertical adjustment bolt 62, so that the stopper 61 is moved upward. The stopper 61 is fastened to the L-shaped block 61, the L-shaped block 60 is fastened to the vertical-moving plate 53, and the pot holder 30 is fastened to the vertical-moving plate 53 via the pot-fastening support 55; accordingly, the sliders 54 fastened to the vertical-moving plate 53 move upward along the guide rails 52 so that the ink pot 31 is lifted together with the pot holder 30 when the stopper 61 is lifted upward as described above.

When the ink pot 31 has thus been lifted above the printing plate 25, the spring force of the loading springs 41 acts on the pressing members 40; and the pressing members 40 act, via the spacer 39, on the cover 38 fastened to the blade 35 of the ink pot 31. Accordingly, the cover 38 is separated from the rotation-stop members 45.

Then, with the ink pot 31 separated from the printing plate 25, the knob 63 is turned in the opposite direction from that described above. As a result, the pot holder 30 and the ink pot 31 are lowered by the spring force of the springs 69 in an action which is the opposite of that described above, so that the blade 35 of the ink pot 31 comes into contact tightly to the printing plate 25.

When the knob 63 is turned even further, the ink pot 31 is not lowered since the blade 35 is in contact with the printing plate 25, and only the pot holder 30 is lowered. If the pot holder 30 is thus lowered, the inclined surfaces 45*a* and 45*b* of the rotation-stop members 45 contact the corners of the cover 58 fastened to the blade 35. Thus, the knob 63 is turned until the rotation-stop members 45 reach a point immediately prior to the point where the rotation-stop members 45 contact the cover 58. As a result, the blade 35 of the ink pot 31 is pressed against the printing plate 25 by the loading springs 41. The load pressing the blade 35 against the printing plate 25 is then adjusted by turning the load adjustment screws 44.

A preparatory work is thus completed.

The table 22 is then moved horizontally by a horizontal driving means in the direction of arrow A with the blade 35 positioned on the recessed area 25*a* of the printing plate 25, and with the lower end of the blade 35 kept pressed against the printing plate 25 by the driving force of the load adjustment screws 44, the ink 32 inside the ink reservoir 36*c* uniformly fills the recessed area 25*a* of the printing plate 25.

Figure 7:
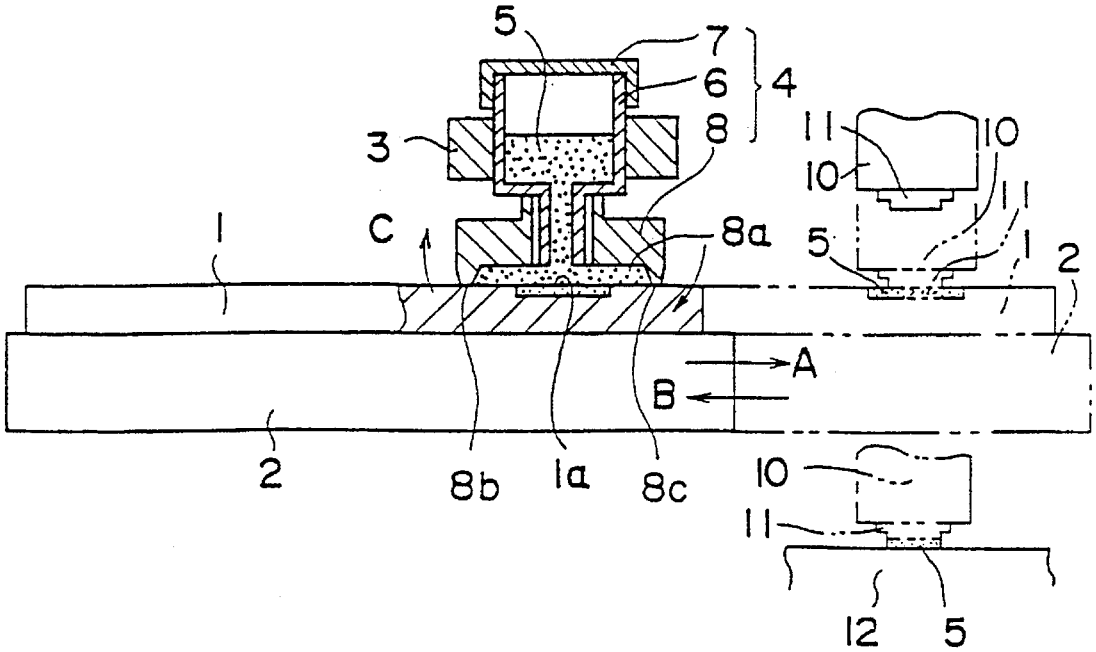
FIG. 7 Prior Art
FIG. 7 is a partially sectional front view of a conventional thin-film supplying device.

Next, the plate holder 10 is actuated as in the prior art shown in FIG. 7. In other words, the rubber relief plate 11 contacts the ink 32 in the recessed area 25*a* so that the ink 32 is applied to the rubber relief plate 11. After this, the plate holder 10 is raised, whereupon the table 22 moves horizontally in the direction of arrow B.

In the present invention, the rotation-stop members 45 for preventing the rotation of the blade 35 are provided on both side surfaces of the pot holder 30 in the direction of movement of the printing plate 25. Accordingly, when the printing plate 25 moves in the direction of arrow B, the upper corner portion of the leading edge of the blade 35 contacts the inclined surfaces 45*a* of the rotation-stop members 45A so that a rotational moment oriented in the direction of arrow D acts on the blade 35 by the rotation-stop members 45A, thus preventing the movement of the blade 35 in the direction of arrow C.

More specifically, the rotation-stop members 45A have an inclined angle (or the inclined surface 45*a*) where the blade 35 makes contact with the rotation-stop members; thus, the rotation-stop members 45A create a vertical component of a force which is pressed on the undersurface of the inclined surfaces 45*a* of the rotation-stop members 45A (i.e., the undersurface of the leading edge of the blade 35) and on the printing plate 25. As a result of this component of the force, the leading-edge undersurface of the blade 35 is prevented from moving in the direction of arrow C or from floating upward. In other words, the rotation-stop members deny any lifting or upward moment that occurs at the end of the blade 35.

The ink 32 is scraped by the leading edge of the blade 35 which is kept prevented from floating upward as described above. Accordingly, the ink 32 enters the blade 35 even if there is a gap between the printing plate 25 and the trailing-edge undersurface of the blade 35. As a result, no leakage of the ink 32 occurs.

Furthermore, when the printing plate 25 moves in the direction of arrow A, the blade 35 contacts the inclined surfaces 45*b* of the rotation-stop members 45B, so that the undersurface of the blade 35 on the side facing the rotation-stop members 45B is prevented from floating upward. Thus, the leakage of ink 32 is prevented in this case too. Since the blade 35 is thus prevented from floating upward, the leakage of ink 32 is prevented, and the amount of ink 32 consumed can be reduced greatly.

As seen from the above, the pot insertion hole 30*a* in the pot holder 30 is made slightly larger (approximately 1 mm larger) than the external diameter of the ink pot 31, thus allowing the rotation of the ink pot 31. In addition, the blade 35 of the ink pot 31 is pressed against the printing plate 25 by the loading springs 41 attached to the pot holder 30. Accordingly, the blade 35 constantly conforms to the surface of the printing plate 25 by the loading springs 41. Thus, there is no need for any adjustment work to insure that the undersurface of the blade 35 is parallel to the surface of the printing plate 25.

Moreover, the undersurface of the blade 35 of the ink pot 31 has a square shape. Accordingly, the undersurface scrapes the ink 32 inside the recessed area 25*a* by making linear contact with the printing plate 25, and a uniform thin film of ink 32 can be supplied to the recessed area 25*a* of the printing plate 25.

If the printing plate 25 is made of super-steel and the blade 35 is made of hardened SK material, the friction between the printing plate 25 and the blade 35 would be great. In such a case, ink 32 which has leaked from the blade 35 will be dried by the friction between the printing plate 25 and the ink pot 31, and the friction becomes even greater. As a result, this friction may overcome the torque of the motor which drives the reciprocating movement of the table 22, so that the motor making the horizontal movement stops. However, the blade 35 is made of a ceramic material in the present invention. Accordingly, the friction between the printing plate 25 and the blade 35 is small, and the leakage of the ink 32 from the blade 35 can act as a lubricating oil, thus allowing smooth reciprocating motion of the table 22. In addition, there will be no excessive leakage of ink.

In the above description, the table 22 is driven in a reciprocating manner. However, it can be designed so that the table 22 is fixed in place and the pot holder 30 is movable in a reciprocating fashion.

As seen from the above, in the present invention, the rotation-stop members which prevent the rotation of the blade are provided on both sides of the pot holder in the direction of relative movement between the pot and the printing plate. Accordingly, ink leakage can be prevented, and the amount of ink consumed can be greatly reduced.

Furthermore, in the present invention, the pot is held in the pot holder with a slight gap between the two, and the pot is urged by a multiple number of springs mounted to the pot holder so as to be pressed against the printing plate. Accordingly, there is no need for adjustment work that is to obtain a parallel orientation of the blade.

In addition, since the blade has square shape, a thin film of ink can be uniformly supplied.

We claim:

1. A device for supplying a thin-film of ink comprising: a printing plate which has a recessed area formed in its upper surface, a table which holds said printing plate, a pot which accommodates ink and has a blade that has an ink reservoir formed in a lower end of said blade, a pot holder which holds said pot, and a horizontal driving means which moves said printing plate and said pot horizontally relative to each other with an undersurface of said blade of said pot pressed against an upper surface of said priming plate, wherein rotation-stop members are provided on both side surfaces of said pot holder in a direction relative to movement between said pot and printing plate and engaged with an upper edge of said blade when said blade is moved relative to said printing plate for preventing rotation of said blade upwardly from said printing plate.

2. A device for supplying a thin-film of ink comprising: a printing plate which has a recessed area formed in its upper surface, a table which holds said printing plate, a pot which accommodates ink and has a blade that has an ink reservoir formed in a lower end of said blade, a pot holder which holds said pot, and a horizontal driving means which moves said printing plate and said pot horizontally relative to each other with an undersurface of said blade of said pot pressed against an upper surface of said printing plate, wherein rotation-stop members are provided on both side surfaces of said pot holder in a direction of relative movement between said pot and printing plate and engaged with an upper edge of said blade when said blade is moved relative to said printing plate for preventing rotation of said blade upwardly from said printing plate, said pot is held on said pot holder with a gap between said pot and said pot holds, and a multiple number of springs are mounted between said pot holder and said pot for pressing said pot against said printing plate.

3. A device according to claim 1, wherein said blade has square shape.

4. A device according to claim 2, wherein said blade has square shape.

5. A device according to claim 1, wherein said blade is made of ceramics.

6. A device according to claim 2, wherein said blade is made of ceramics.

7. A device for supplying a thin-film of ink comprising:

a horizontally movable table, a printing plate provided on said table, said printing plate having a recessed area formed in an upper surface of said printing plate;

a pot holder provided above said printing plate so as to be vertically movable;

a pot installed in said pot holder, said pot storing ink therein and having a square blade at a bottom of said pot, said blade being made of ceramic and having an ink reservoir in a lower end of said blade so as to be pressed against said printing plate and supplying ink from said reservoir to said recessed area of said printing plate; and rotation-stop members provided on said pot holder engaging with an upper edge of said blade for preventing a lifting moment from occurring at an end portion of said blade when said blade is moved relative to said printing plate.

* * * * *